US011230028B2

(12) United States Patent
Sarius et al.

(10) Patent No.: US 11,230,028 B2
(45) Date of Patent: Jan. 25, 2022

(54) LIGHTWEIGHT CHAINSAW GUIDE BAR

(71) Applicant: HUSQVARNA AB, Huskvarna (SE)

(72) Inventors: Niklas Sarius, Jönköping (SE); Christian Liliegård, Jönköping (SE); Jörgen Johansson, Jönköping (SE)

(73) Assignee: Husqvarna AB, Huskvarna (SE)

( * ) Notice: Subject to any disclaimer, the term of this patent is extended or adjusted under 35 U.S.C. 154(b) by 0 days.

(21) Appl. No.: 16/093,692

(22) PCT Filed: Apr. 5, 2017

(86) PCT No.: PCT/EP2017/058068
§ 371 (c)(1),
(2) Date: Oct. 15, 2018

(87) PCT Pub. No.: WO2017/178295
PCT Pub. Date: Oct. 19, 2017

(65) Prior Publication Data

US 2019/0134844 A1 May 9, 2019

Related U.S. Application Data

(60) Provisional application No. 62/322,836, filed on Apr. 15, 2016.

(51) Int. Cl.

| | |
|---|---|
| ***B27B 17/02*** | (2006.01) |
| ***B27B 17/12*** | (2006.01) |
| ***B27B 17/14*** | (2006.01) |

(52) U.S. Cl.
CPC ..... *B27B 17/025* (2013.01); *B27B 17/12* (2013.01); *B27B 17/14* (2013.01)

(58) Field of Classification Search
CPC ..... B27B 17/02; B27B 17/025; B27B 17/04
(Continued)

(56) References Cited

U.S. PATENT DOCUMENTS 2,811,342 A * 10/1957 McCallum ..... B27B 17/025 299/82.1
2,925,105 A * 2/1960 Hayden ..... B27B 17/0016 30/371

(Continued)

FOREIGN PATENT DOCUMENTS

EP 1 950 015 A1 7/2008

OTHER PUBLICATIONS

Definition of recessed and hole via Wiktionary.org Definition of holes via Wikipedia.org (Year: 2020).*

(Continued)

*Primary Examiner* — Richard D Crosby, Jr.
(74) *Attorney, Agent, or Firm* — Burr & Forman, LLP

(57) ABSTRACT

A chainsaw (100) includes a power unit and a working assembly powered responsive to operation of the power unit. The working assembly includes a guide bar (120) around which a chain is rotatable. The guide bar (120) includes a first side plate (200) and a second side plate (210) facing each other and extending away from the housing (110) to a nose of the guide bar (120), the first and second side plates (200 and 210) each including an inner sidewall (224 and 222) facing inwardly toward each other. Each of the inner sidewalls (224 and 222) includes a recessed portion (230) at which material of the inner sidewalls (224 and 222) has been removed.

20 Claims, 14 Drawing Sheets

(58) Field of Classification Search
USPC ..... 30/381–387
See application file for complete search history.

(56) References Cited

U.S. PATENT DOCUMENTS 3,410,147 A * 11/1968 Scott-Jackson ..... B27B 17/08 474/164
3,416,578 A * 12/1968 Irgens ..... B27B 17/025 30/387
3,545,505 A * 12/1970 Deweese ..... B27B 17/025 83/821
3,949,475 A * 4/1976 Tokarz ..... B27B 17/02 30/387
4,138,813 A * 2/1979 Harada ..... B27B 17/025 30/387
4,361,960 A * 12/1982 Halverson ..... B27B 17/02 30/123.4
4,393,590 A * 7/1983 Pantzar ..... B27B 17/12 30/387
4,486,953 A * 12/1984 Halverson ..... B27B 17/02 30/385
4,693,007 A * 9/1987 Apfel ..... B27B 17/025 30/383
4,794,696 A * 1/1989 Apfel ..... B27B 17/025 30/383
5,025,561 A * 6/1991 Sugihara ..... B27B 17/025 30/383
5,035,058 A * 7/1991 Date ..... B27B 17/025 30/383
5,050,303 A * 9/1991 Sinclair ..... B27B 17/02 30/123.4
5,067,243 A * 11/1991 O'Neel ..... B27B 17/025 264/46.5
5,092,044 A * 3/1992 Edgerton ..... B27B 17/12 30/123.4
5,216,814 A * 6/1993 McGregor ..... B27B 17/025 30/123.4
5,249,363 A * 10/1993 Mitrega ..... B27B 17/025 30/387
5,564,192 A * 10/1996 Wilhelm ..... B27B 17/025 30/383
5,634,273 A * 6/1997 Michels ..... B27B 17/025 30/123.4
5,797,187 A * 8/1998 Leini ..... A01G 23/091 144/34.1
5,842,279 A * 12/1998 Andress ..... B27B 17/025 30/387
5,845,402 A * 12/1998 Leini ..... B27B 17/02 30/123.4
5,878,607 A * 3/1999 Nunes ..... B23D 59/001 30/124
5,884,406 A * 3/1999 Leini ..... B27B 17/025 30/383
6,138,339 A * 10/2000 Escher ..... B27B 17/025 29/418
6,427,342 B1 * 8/2002 Breitbarth ..... B27B 17/025 30/383
6,698,101 B2 * 3/2004 Chen ..... B27B 17/025 30/383
6,964,101 B2 * 11/2005 Graves ..... B27B 17/025 30/383
7,631,430 B2 * 12/2009 Chang ..... B27B 17/025 30/381
7,818,886 B1 * 10/2010 Grindstaff ..... B27B 17/04 30/383
8,661,695 B2 * 3/2014 Hermansen ..... B27B 17/025 30/383
10,040,214 B2 * 8/2018 Baratta ..... B27B 17/12
2008/0244915 A1 * 10/2008 Ruth ..... B27B 17/025 30/387
2011/0192039 A1 * 8/2011 Fuchs ..... B27B 17/025 30/383
2012/0176806 A1 * 7/2012 Baratta ..... B27B 17/02 362/382
2013/0031793 A1 * 2/2013 Baratta ..... B27B 17/025 30/387
2014/0250701 A1 * 9/2014 Amend ..... B27B 17/025 30/383
2015/0052762 A1 * 2/2015 Fuchs ..... B27B 17/025 30/387
2018/0015632 A1 * 1/2018 Johansson ..... B27B 17/12
2018/0036901 A1 * 2/2018 Tsumura ..... B27B 17/025
2018/0043566 A1 * 2/2018 Liliegard ..... B27B 17/12
2018/0050463 A1 * 2/2018 Johansson ..... B27B 17/04
2019/0118404 A1 * 4/2019 Sarius ..... B27B 17/025
2019/0134844 A1 * 5/2019 Sarius ..... B27B 17/025

OTHER PUBLICATIONS

International Search Report and Written Opinion for International Application No. PCT/EP2017/058068 dated Jun. 21, 2017.
International Preliminary Report on Patentability for International Application No. PCT/EP2017/058068 dated Oct. 16, 2018.

* cited by examiner

LIGHTWEIGHT CHAINSAW GUIDE BAR

TECHNICAL FIELD

Example embodiments generally relate to hand held power equipment and, more particularly, relate to a guide bar improvements for a chainsaw.

BACKGROUND

Chainsaws are commonly used in both commercial and private settings to cut timber or perform other rigorous cutting operations. Because chainsaws are typically employed in outdoor environments, and the work they are employed to perform often inherently generates debris, chainsaws are typically relatively robust hand held machines. They can be powered by gasoline engines or electric motors (e.g., via batteries or wired connections) to turn a chain around a guide bar at relatively high speeds. The chain includes cutting teeth that engage lumber or another medium in order to cut the medium as the teeth are passed over a surface of the medium at high speed.

Given that the chainsaw may be employed to cut media of various sizes, the length of the guide bar can be different for different applications. However, in most situations, the guide bar is relatively long, and may actually be substantially longer than the main body of the chainsaw. The guide bar is typically made of steel, and thus, the guide bar can be a substantial contributor to the overall weight of the chainsaw.

Reducing the weight of the chainsaw can allow it to be more easily controlled and carried for long periods of time. However, weight is not the only concern or point of possible improvement in relation to guide bar design. As such, it may be desirable to explore a number of different guide bar design improvements that could be employed alone or together to improve overall chainsaw performance.

BRIEF SUMMARY OF SOME EXAMPLES

Some example embodiments may provide for a guide bar constructed with laminated sheets of the same or different types of materials. The laminate sheets include at least two metallic side plates that have material removed from their inwardly facing interior portions. This material removal lightens the weight of the guide bar. However, areas around those at which the material that is removed are strategically selected to retain good strength, and to allow the laminated sheets to be joined together by any of a number of different methods. Other improvements may also be possible, and the improvements can be made completely independent of each other, or in combination with each other in any desirable configuration. Accordingly, the operability and utility of the chainsaw may be enhanced or otherwise facilitated while lightening the guide bar without sacrificing strength.

A chainsaw of an example embodiment may include a power unit and a working assembly powered responsive to operation of the power unit. The working assembly includes a guide bar around which a chain is rotatable. The guide bar includes a first side plate and a second side plate facing each other and extending away from the housing to a nose of the guide bar, the first and second side plates each including an inner sidewall facing inwardly toward each other. Each of the inner sidewalls includes a recessed portion at which material of the inner sidewalls has been removed.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
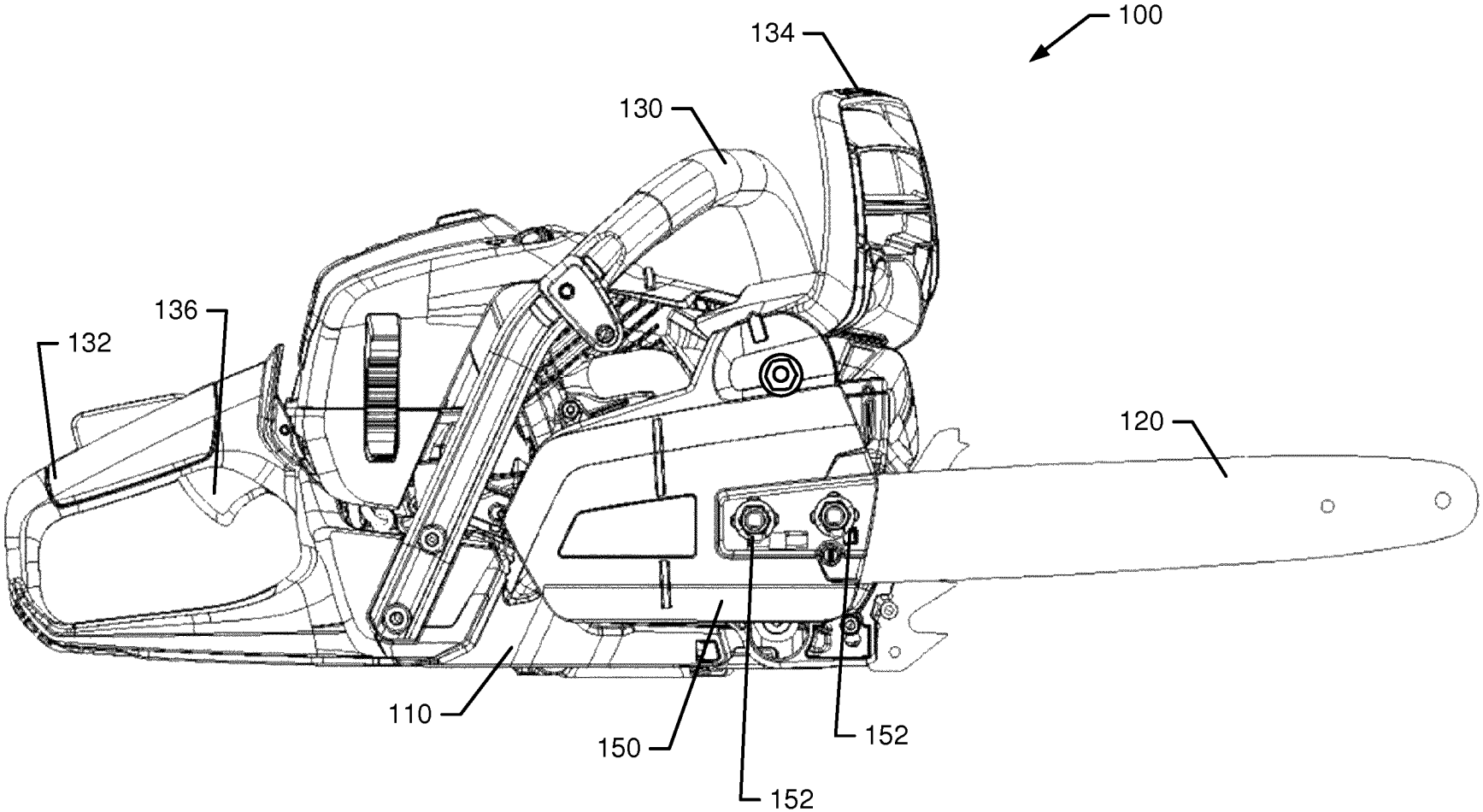
FIG. 1 illustrates a side view of a chainsaw according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

FIG. 1 illustrates side view of a chainsaw 100 according to an example embodiment. As shown in FIG. 1, the chainsaw 100 may include a housing 110 inside which a power unit or motor (not shown) is housed. In some embodiments, the power unit may be either an electric motor or an internal combustion engine. Furthermore, in some embodiments, the power unit may include more than one electric motor where one such electric motor powers the working assembly of the chainsaw 100 and the other electric motor of the power unit powers a pump that lubricates the working assembly or provides momentum for moving other working fluids within the chainsaw 100. The chainsaw 100 may further include a guide bar 120 that is attached to the housing 110 along one side thereof. A chain (not shown) may be driven around the guide bar 120 responsive to operation of the power unit in order to enable the chainsaw 100 to cut lumber or other materials. The guide bar 120 and the chain may form the working assembly of the chainsaw 100. As such, the power unit may be operably coupled to the working assembly to turn the chain around the guide bar 120.

The chainsaw 100 may include a front handle 130 and a rear handle 132. A chain brake and front hand guard 134 may be positioned forward of the front handle 130 to stop the movement of the chain 122 in the event of a kickback. In an example embodiment, the hand guard 134 may be tripped by rotating forward in response to contact with a portion of the arm (e.g., the hand/wrist) of the operator of the chainsaw 100. In some cases, the hand guard 134 may also be tripped in response to detection of inertial measurements indicative of a kickback.

The rear handle 132 may include a trigger 136 to facilitate operation of the power unit when the trigger 136 is actuated. In this regard, for example, when the trigger 136 is actuated (e.g., depressed), the rotating forces generated by the power unit may be coupled to the chain either directly (e.g., for electric motors) or indirectly (e.g., for gasoline engines). The term "trigger," as used herein, should be understood to represent any actuator that is capable of being operated by a hand or finger of the user. Thus, the trigger 136 may represent a button, switch, or other such component that can be actuated by a hand or portion thereof.

Some power units may employ a clutch to provide operable coupling of the power unit to a sprocket that turns the chain. In some cases (e.g., for a gasoline engine), if the trigger 136 is released, the engine may idle and application of power from the power unit to turn the chain may be stopped. In other cases (e.g., for electric motors), releasing the trigger 136 may secure operation of the power unit. The housing 110 may include a fuel tank for providing fuel to the power unit. The housing 110 may also include or at least partially define an oil reservoir, access to which may be provided to allow the operator to pour oil into the oil reservoir. The oil in the oil reservoir may be used to lubricate the chain as the chain is turned.

As can be appreciated from the description above, actuation of the trigger 136 may initiate movement of the chain around the guide bar 120. A clutch cover 150 may be provided to secure the guide bar 120 to the housing 110 and cover over the clutch and corresponding components that couple the power unit to the chain (e.g., the sprocket and clutch drum). As shown in FIG. 1, the clutch cover 150 may be attached to the body of the chainsaw 100 (e.g., the housing 110) via nuts 152 that may be attached to studs that pass through a portion of the guide bar 120. The guide bar 120 may also be secured with the tightening of the nuts 152, and a tightness of the chain can be adjusted based on movement of the guide bar 120 and subsequent tightening of the nuts 152 when the desired chain tightness is achieved. However, other mechanisms for attachment of the clutch cover 150 and/or the guide bar 120 may be provided in other embodiments including, for example, some tightening mechanisms that may combine to tighten the chain in connection with clamping the guide bar 120.

As mentioned above, the guide bar 120 can be an important contributor to the weight of the chainsaw 100. Thus, it may be desirable to provide various improvements to the guide bar 120 to improve the functionality and/or decrease the weight of the guide bar 120. Various example embodiments will now be described in reference to FIGS. 2-6, which illustrate some of these example embodiments.

Figure 2:
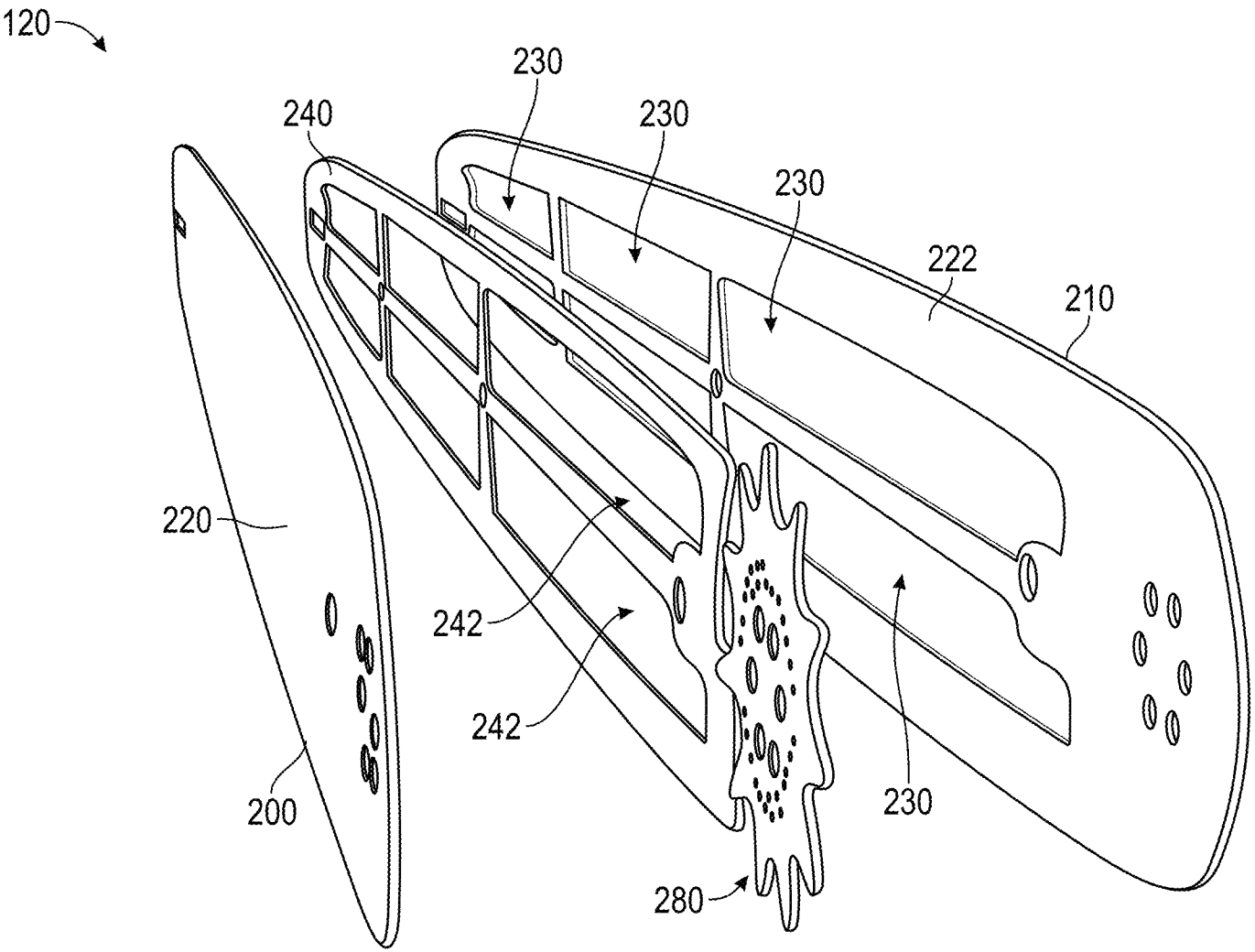
FIG. 2 illustrates an exploded perspective view the guide bar in accordance with an example embodiment.
Figure 3A:
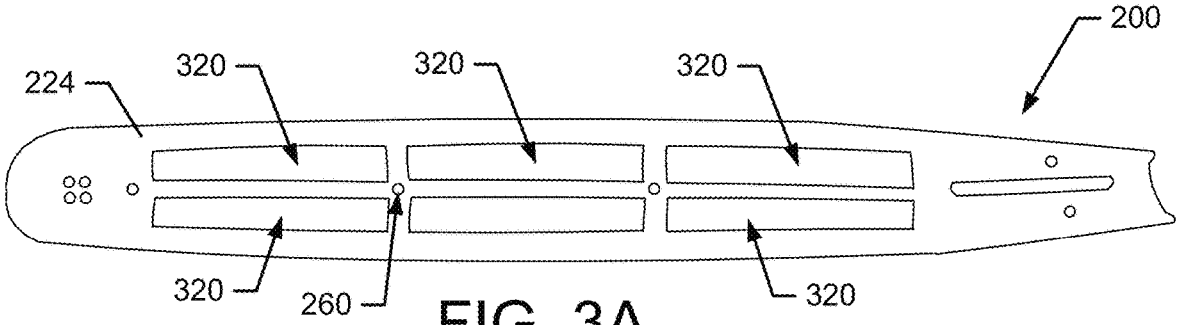
FIG. 3A illustrates a side view of a first side plate with recessed portions distributed on an inner sidewall in accordance with an example embodiment.
Figure 3B:
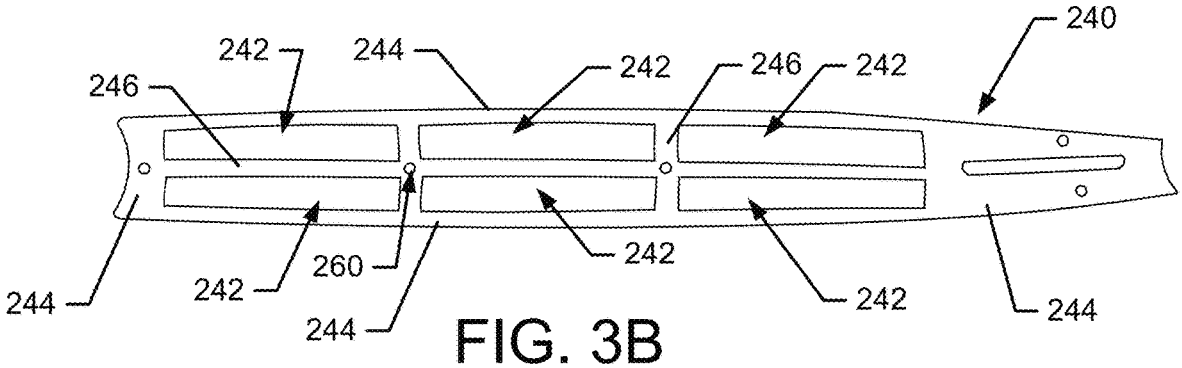
FIG. 3B illustrates a side view of a base plate having cutout portions formed therein between ribs and a peripheral portion in accordance with an example embodiment.
Figure 3C:
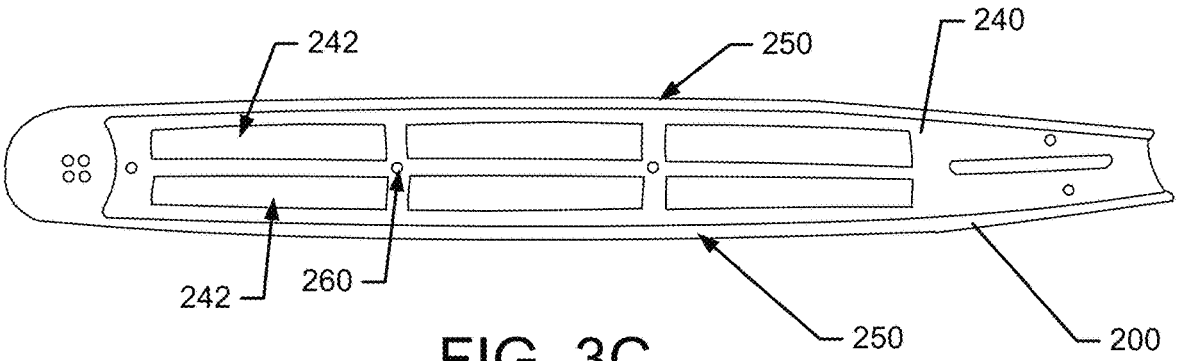
FIG. 3C illustrates a side view of the base plate and first side plate combined together in accordance with an example embodiment.

In this regard, FIG. 2 illustrates an exploded perspective view the guide bar 120 in accordance with an example embodiment. FIG. 3, which includes FIGS. 3A, 3B and 3C, illustrates a side view (or top view) of various components of the guide bar 120 in accordance with an example embodiment. Referring to FIGS. 2 and 3, it can be appreciated that the guide bar 120 may be formed from multiple laminate sheets that lie in parallel planes along side each other. These laminate sheets may be made from stainless steel and other sufficiently rigid and durable materials. As mentioned above, because steel and other metallic materials tend to have increased weight, some example embodiments may remove some of the metallic material where it is possible to do so, and leave reinforced steel portions in certain strategically important locations. Other materials of a lower weight (e.g., graphene, glass fiber, carbon fiber, or the like) may be employed in some portions of the guide bar 120, as will be discussed below.

In the example of FIGS. 2 and 3, the guide bar 120 includes a first side plate 200 and a second side plate 210, which may form outer portions or surfaces of the guide bar 120. The first and second side plates 200 and 210 may generally be spaced apart from each other be at least a certain distance, which may be substantially consistent over the lengths of the first and second side plates 200 and 210. The consistent spacing between the first and second side plates 200 and 210 may be maintained by the existence of one or more other plates. However, in some cases, the distance may be maintained by extension portions formed or otherwise provided on interior surfaces of the first and second side plates 200 and 210 to extend toward each other. These extension portions will be discussed in greater detail in reference to an alternative example embodiment below.

In the example of FIGS. 2 and 3, the spacing between the first and second side plates 200 and 210 may be maintained by a base plate 240. The base plate 240 and each of the first and second side plates 200 and 210 may be made of sheet metal (e.g., steel) that is relatively thin. However, in some cases, the base plate 240 may be made of a different material than the first and second side plates 200 and 210. For example, the base plate 240 could be made of a non-metallic material, while the first and second side plates 200 and 210 are made of metallic materials. As can be appreciated from FIGS. 2 and 3, the base plate 240 and each of the first and second side plates 200 and 210 may lie in parallel planes when assembled together. In an example embodiment, the first and second side plates 200 and 210 may be formed from relatively thin, plate-like sheets of metallic material that initially has a generally common thickness over the entirety of such sheets. However, in accordance with an example embodiment, portions of the first and second side plates 200 and 210 may be removed (e.g., by milling, etching, and/or the like) to reduce the weight of the guide bar 120. In particular, for example, inwardly facing sidewalls of the first and second side plates 200 and 210 may have some material removed while the outwardly facing sidewalls are left intact.

Referring to FIGS. 2 and 3, an outer sidewall 220 of the first side plate 200 is visible, and an inner sidewall 222 of the second side plate 210 is visible. The inner sidewall 222 of the second side plate 210 faces an inner sidewall 224 of the first side plate 200, and the second side plate 210 should also be understood to have an outer sidewall that faces opposite the outer sidewall 220 of the first side plate 200. Thus, both the inner sidewall 222 of the second side plate 210 and the inner sidewall 224 of the first side plate 200 may have material removed to form recessed portions 230 therein.

The recessed portions 230 of the inner sidewall 222 of the second side plate 210 each have corresponding recessed portions 230 formed on the inner sidewall 224 of the first side plate 200. Thus, the recessed portions 230 mirror each other. Referring now to both of the inner sidewalls 222 and 224, it should be appreciated that the recessed portions 230 may be distributed over interior portions of the respective inner sidewalls 222 and 224. As such, after removal of the material that is removed to form the recessed portions 230, the remaining portions of the inner sidewalls 222 and 224 are raised relative to the recessed portions 230 (in the inward facing direction) around peripheral edges of the recessed portions 230. Thus, the peripheral areas of the inner sidewalls 222 and 224 are raised, and the portions of the inner sidewalls 222 and 224 between each of the recessed portions 230 are also raised.

In this example, the base plate 240 may have cutout portions 242 that are punched, etched, laser cut, water cut, or otherwise formed in the base plate 240 to substantially match the size and shape of the opening of the recessed portions 230. Thus, for example, when the first and second side plates 200 and 210 are joined with the base plate 240 therebetween, recessed portions 230 of the second side plate 210, the cutout portions 242 of the base plate 240 and recessed portions 230 of the first side plate 200 may each be substantially aligned. After the cutout portions 242 are formed, the base plate 240 may be defined by a peripheral portion 244 and ribs 246 that separate the cutout portions 242. Raised portions between the recessed portions 230 of the second side plate 210, the ribs 246 between the cutout portions 242 of the base plate 240, and raised portions between the recessed portions of the first side plate 200 may each also be substantially aligned to allow joining of the base plate 240 to each of the first and second side plates 200 and 210 by any of various different methods.

FIG. 3A illustrates a side view of the first side plate 200 with the recessed portions 230 distributed on the inner sidewall 224. FIG. 3B illustrates a side view of the base plate 240 having the cutout portions 242 formed therein between the ribs 246 and the peripheral portion 244. FIG. 3C illustrates the first side plate 200 joined to the base plate 240 so that the recessed portions 230 are substantially aligned with the cutout portions 242. It can be appreciated that the second side plate 210 could then be joined to the base plate 240 such that the inner sidewall 222 faces the inner sidewall 224 of the first side plate 200 and the recessed portions 230 of the second side plate 210 align with both the recessed portions 230 on the first side plate 200 and the cutout portions 242.

As can be seen in FIG. 3C, the length and height of the base plate 240 is less than the length and height of the first side plate 200. Thus, when the first and second side plates 200 and 210 are joined about the base plate 240, a channel 250 may be formed between peripheral edges of the first and second side plates 200 and 210. The channel 250 may extend around cutting portions of the guide bar 120, but a nose portion of the guide bar 120 may include a nose sprocket 280 to guide the chain around the nose portion. In some cases, the nose sprocket 280 may be a replaceable nose sprocket 280. Thus, some bars may be provided with or without a replaceable nose sprocket. Portions of drive links of the chain will otherwise ride within the channel 250 while cutter links of the chain interface with peripheral edges of the first and second side plates 200 and 210.

Peripheral edges of the base plate 240, and edges of the cutout portions 242 may provide interface regions that can be joined using various adhesion mechanisms. For example, the base plate 240 may be joined to the first side plate 200 (and the second side plate 210) at or near any or all portions of the peripheral edges of the base plate 240 and edges of the cutout portions 242 via welding (e.g., laser welding or spot welding), soldering, or the provision of adhesive materials. In some cases, adhesive materials could be applied to opposing faces of the base plate 240 to adhere the base plate 240 to corresponding contact portions with each of the first and second side plates 200 and 210. If spot welding is employed, the edges may be welded at selected locations. If laser welding or soldering is performed, continuous weld or solder joints may be employed along all or substantial portions of the edges.

As can be appreciated from the descriptions above in reference to FIGS. 2 and 3, the guide bar 120 may be made from at least three laminate sheets where internal gaps are formed at the interior of the guide bar 120 so that the reduction in material results in a corresponding reduction in weight of the guide bar 120 without sacrificing strength. The guide bar 120 (and each respective one of the laminate sheets or layers) may have one or more rivets or other connectors that can pass through each sheet or layer via orifices 260 formed in each respective sheet or layer to further assist in holding the sheets or layers together and preventing delaminating.

Although some embodiments can be practiced with three laminate sheets, as described above, it is also possible that more or fewer laminate sheets could be employed in various alternative embodiments. For example, the base plate 240 could be eliminated in some designs, and the creation of a channel for the drive links of the chain could be accomplished either by adding additional spacer material on to each of the side plates, or by milling or otherwise removing material from the side plates to leave enough material in certain locations to allow for separation to be defined between the side plates to define the channel. FIG. 4 illustrates an example of such an embodiment.

Figure 4A:
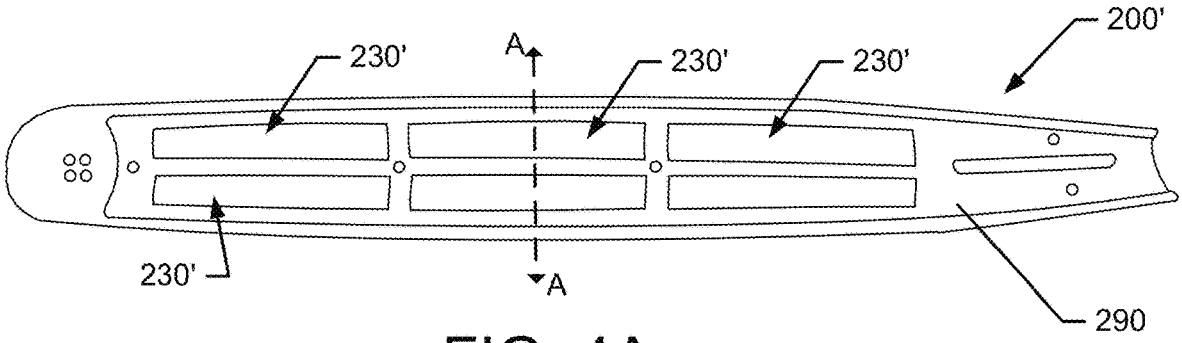
FIG. 4A is a side view of the first side plate in accordance with an example embodiment.
Figure 4B:
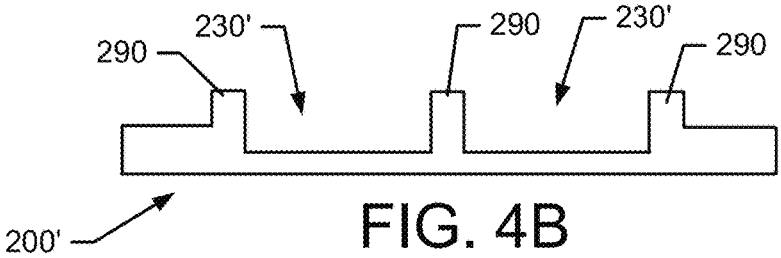
FIG. 4B is a cross section view of the first side plate taken along line A-A' of FIG. 4A in accordance with an example embodiment.
Figure 4C:
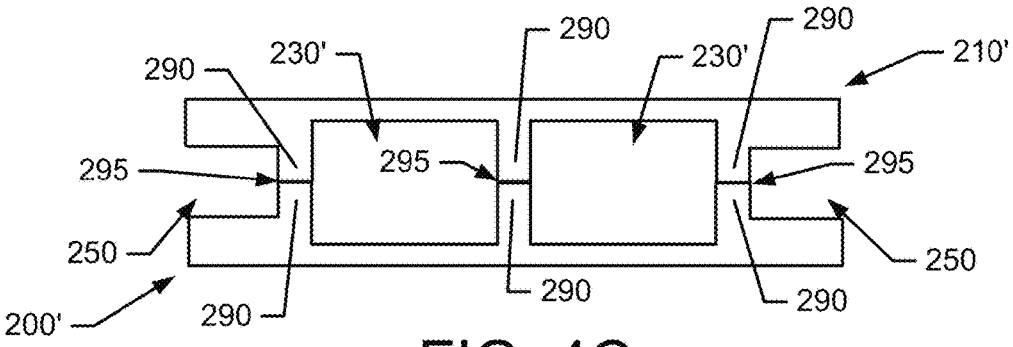
FIG. 4C is cross section view of the first side plate after combination with the second side plate taken along the line A-A of FIG. 4A in accordance with an example embodiment.

Referring now to FIG. 4, which includes FIGS. 4A, 4B and 4C, an example is provided in which slightly modified first and second side plates 200' and 210' are employed without a base plate. FIG. 4A is a side view of the first side plate 200' in accordance with an example embodiment. FIG. 4B is a cross section view of the first side plate 200' taken along line A-A' of FIG. 4A. FIG. 4C is cross section view of the first side plate 200' after combination with the second side plate 210' taken along the line A-A of FIG. 4A. As can be seen in FIGS. 4B and 4C, the first and second side plates 200' and 210' each have portions thereof that have three different thicknesses. The thinnest part of the first and second side plates 200' and 210' corresponds to the portions thereof where material is removed to form the recessed portions 230'. The portions of the first and second side plates 200' and 210' with intermediate thickness correspond to peripheral edges, the nose portion, and the portion that interfaces with the chainsaw 100 and housing 110. Finally, the portions of the first and second side plates 200' and 210' that are thickest correspond to areas added onto the laminate sheet (or left after material removal) to approximate the function and shape/size of the base plate of the prior example structures. Moreover, as can be appreciated from FIG. 4C, the base plate has effectively been split in half, with each half being affixed to its respective side plate.

The thickest portions of the first and second side plates 200' and 210' may be referred to as raised portions 290. These raised portions 290 may meet each other to maintain sufficient space between peripheral regions of the first and second side plates 200' and 210' to form the channel 250 similar to the example above. Opposing faces of the raised portions 290 of respective ones of the first and second side plates 200' and 210' may meet at an interface 295. Although FIG. 4C illustrates an example where the first and second side plates 200' and 210' mirror each other to meet at the interface 295, it should be appreciated that the design of FIG. 4C could be substantially duplicated with one flat side plate and the other side plate having raised portions extended to be as long as both the raised portions 290 of FIG. 4C. This would represent a simpler design option since only one of the side plates would be milled and the other would be substantially flat.

In another alternative, it should be appreciated that either or both of the first and second side plates 200' and 210' could be composite plates. The same could also be true of the first and second side plates 200 and 210 described above. In either case, a flat outer plate may be welded or otherwise joined to an inner plate that is laser cut or punched to include boundaries to define the recessed portions 230 and 230'. This may allow the recessed portions 230 and 230' to effectively be formed without any milling.

Any of a number of different joining methods may be employed at one or more of the interfaces 295. For example, welding (e.g., laser welding or spot welding), soldering, or the provision of adhesive materials may be used to join one or more of the interfaces 295. In some cases, adhesive materials could be applied to the opposing faces at the interfaces 295 to adhere the corresponding contact portions of each of the first and second side plates 200' and 210'. If spot welding is employed, the inner or outer edges of the interfaces 295 may be welded at selected locations. If laser welding or soldering is performed, continuous weld or solder joints may be employed along all or substantial portions of the inner or outer edges of the interfaces 295. In some cases, welding or soldering could be employed at the interfaces 295 proximate to the channel 250 via the channel 250 opening. However, in some cases, laser welding or other welding techniques may be employed to weld the side plates together, and/or to weld the side plates together with any base plate in use. In such an example, the welding may be accomplished through one of the side plates to weld all components together.

Figure 5A:
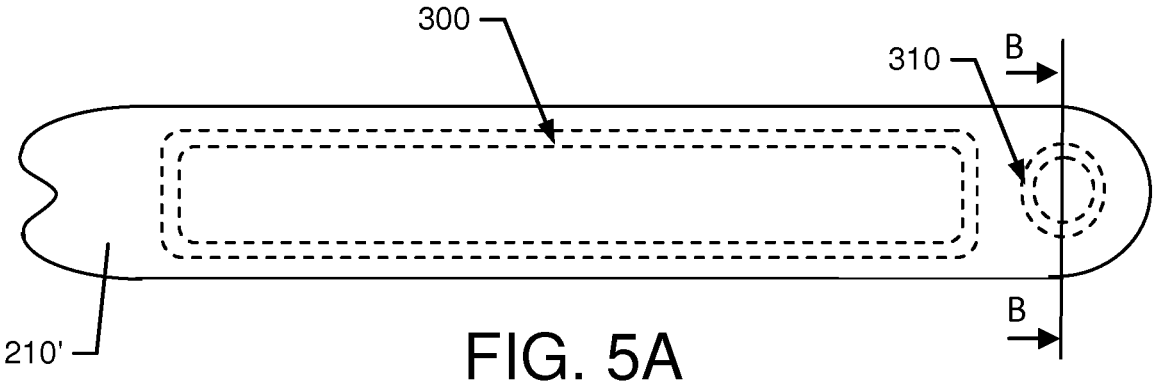
FIG. 5A illustrates a side view of a first side plate in accordance with an example embodiment.
Figure 5B:
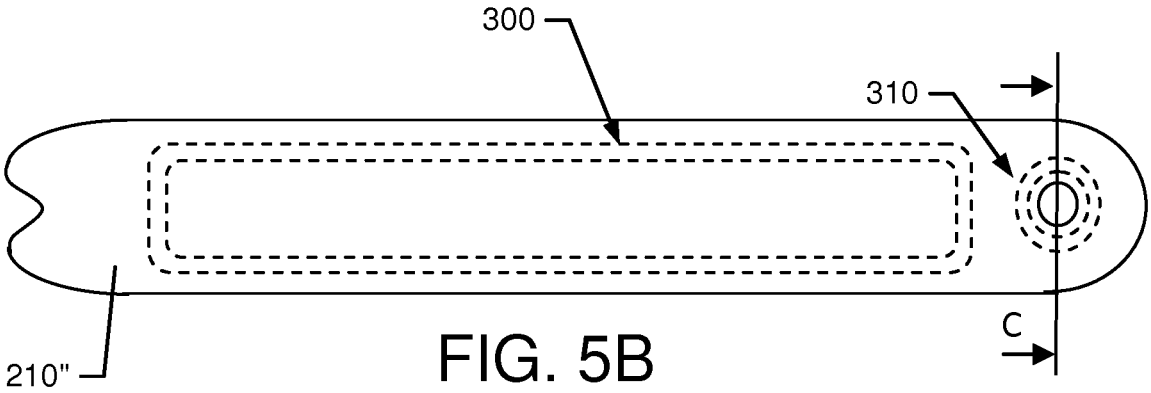
FIG. 5B illustrates a side view of a second side plate according to an example embodiment.

FIG. 5A illustrates a side view of an example first side plate 200" and FIG. 5B illustrates a side view of an example second side plate 210" according to an example embodiment. The outline region 300 may represent an area of the first and second side plates 200" and 210" on which adhesive may be applied to allow the raised portions (similar to raised portions 290 of FIG. 4C to be adhered to each other. In this example, and the above examples in which adhesives are employed, surfaces to which adhesives are to be applied may first be pretreated with plasma to ensure cleanliness of such surfaces.

Figure 5C:
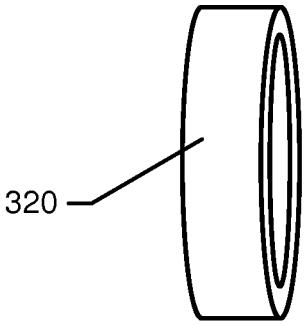
FIG. 5C illustrates a perspective view of s wear ring in accordance with an example embodiment.
Figure 5D:
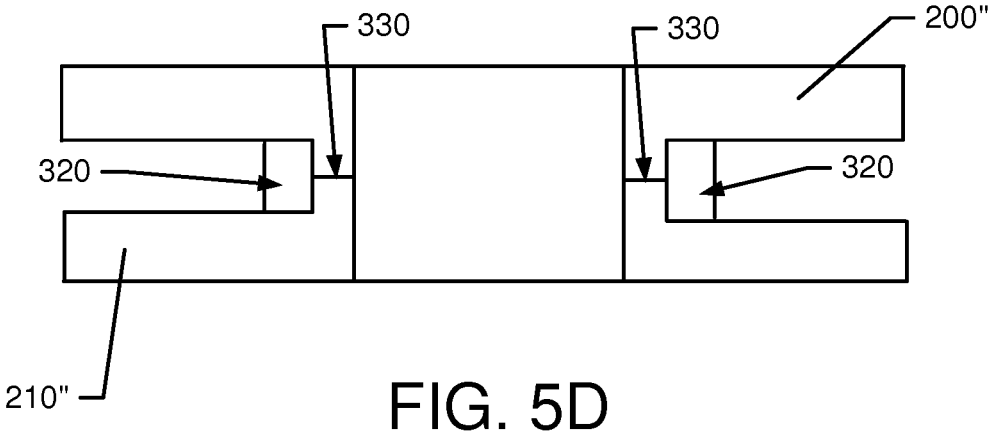
FIG. 5D illustrates cross section view along lines C-C of FIG. 5B in accordance with an example embodiment.
Figure 5E:
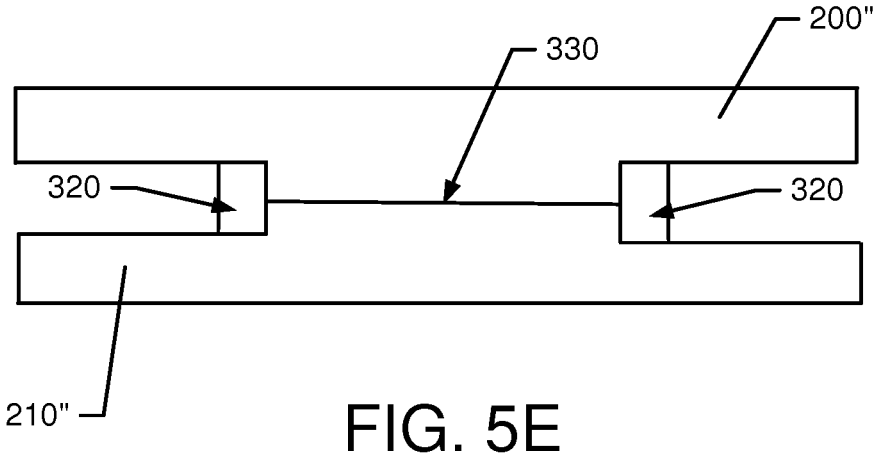
FIG. 5E illustrates cross section view along lines B-B of FIG. 5A in accordance with an example embodiment.

As also shown in FIGS. 5A and 5B, cross sections along lines B-B and C-C, respectively, may be drawn at an area of the nose section so that the views of FIGS. 5D and 5E to help illustrate how pinching of the nose section may be prevented. In this regard, for example, a nose sprocket hub 310 may be defined on the first and second side plates 200" and 210". The nose sprocket hub 310 may provide an area at which the nose sprocket 280 can be supported (see FIG. 2), and a wear ring 320 (see FIG. 5C) may be employed in connection with provision of the nose sprocket 280 to improve wear resistance by providing a wear surface between the hub 310 and nose sprocket 280, or between the hub 310 and bearing discs of the nose sprocket 280. The wear ring 320, nose sprocket 280 and bearing discs can be manufactured for low friction and low wear by choosing materials or combinations of materials that are suitable or have surface treatments or coatings.

FIG. 5C illustrates a perspective view of the wear ring 320, and FIGS. 5D and 5E illustrate the cross section views along lines C-C and B-B, respectively. As shown in FIGS. 5D and 5E, the first and second side plates 200" and 210" may meet to form the hub 310 based on a hollow structure and protrusion that can fit therein. Where the first and second side plates 200" and 210" meet, an adhesive area 330 may be formed at which surfaces facing each other can be joined with adhesive.

The examples above each relate to the provision of side plates with hollowed out portions (e.g., the recessed portions 230 and 230') that facilitate lightening the overall weight of the guide bar 120. One such example employed a base plate, but the other did not. However, in both cases, the recessed portions 230 and 230' are provided to substantially mirror each other about a plane passing through a center of the guide bar 120 parallel to the planes in which the laminate sheets lie. The recessed portions 230 and 230' are formed to face each other, and are formed by removing material from inwardly facing sidewalls of the side plates of the guide bar 120. However, it may be possible in some cases to remove the material all the way through the side plates instead of just in the inwardly facing sidewalls. Such an example is shown in FIG. 6, which includes FIGS. 6A, 6B, 6C, 6D and 6E.

Figure 6A:
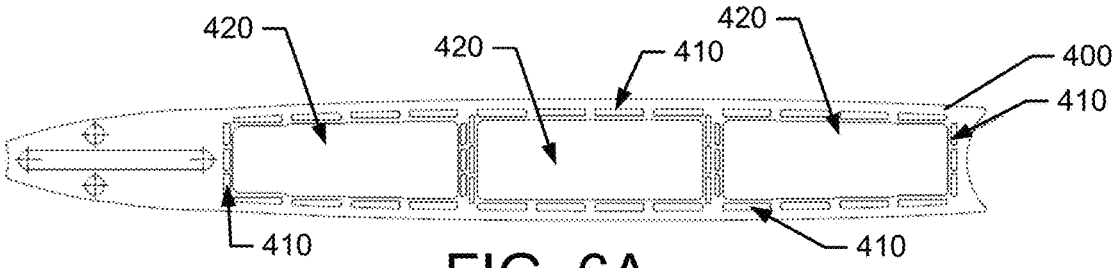
FIG. 6A illustrates a side view of an alternative base plate structure in accordance with an example embodiment.

FIG. 6A illustrates a side view of a base plate 400 in accordance with an example embodiment. The base plate 400 may be made of steel, or another rigid material similar to the base plate 240 described above. However, the base plate 400 may have a plurality of eyelets 410 formed around various cutout portions 420 formed in the base plate 400 by punching, etching, cutting or other suitable means. The eyelets 410 may be positioned around a periphery of each of the cutout portions 420 to face each other. Thus, an array of eyelets 410 equal in number and size may be provided on each opposing side of the cutout portions 420. In this example, eyelets 410 disposed to run parallel to a longitudinal axis of the base plate 400 may be longer and greater in number than eyelets 410 disposed to run perpendicular to the longitudinal axis of the base plate 400.

Figure 6B:
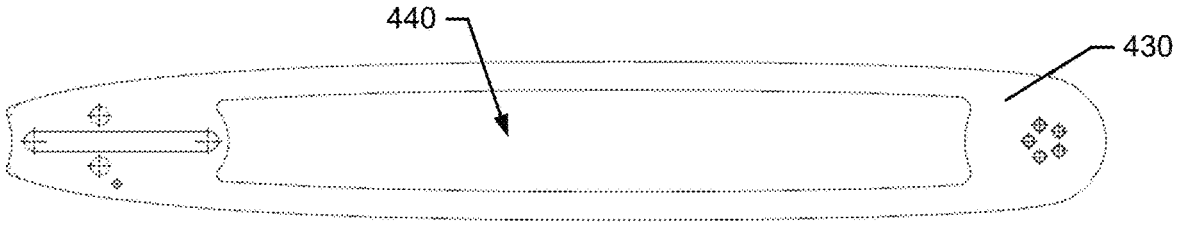
FIG. 6B illustrates a side view of an alternative side plate structure in accordance with an example embodiment.
Figure 6C:
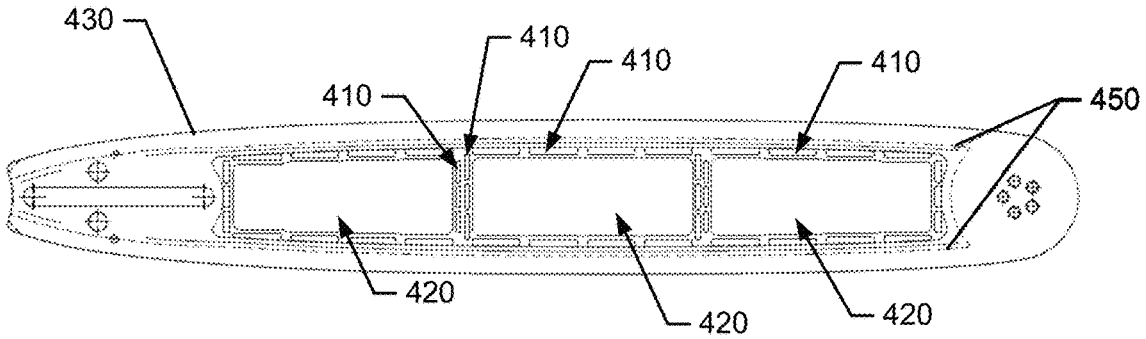
FIG. 6C illustrates a side view of the base plate and side plate combined together in accordance with an example embodiment.

FIG. 6B illustrates a first side plate 430 having a recessed portion 440 formed therein. The recessed portion 430 may actually pass entirely through the thickness of the first side plate 430 in interior regions (spaced apart from the periphery of the first side plate 430). FIG. 6C shows the base plate 400 operably coupled to the first side plate 430. In this example, the base plate 400 is on the opposite side of the first side plate 430 relative to the viewer, and the dashed lines illustrate an interface 450 at the edges of the base plate 400 where the joining (e.g., by laser welding or other joining methods) of the base plate 400 and the first side plate 430 may be provided. As can be seen from FIG. 6C, the eyelets 410 are all exposed in the recessed portion 440 of the first side plate 430. A second side plate may be attached to an opposite side of the base plate 400 and affixed thereto by any of the mechanisms described above.

Figure 6D:
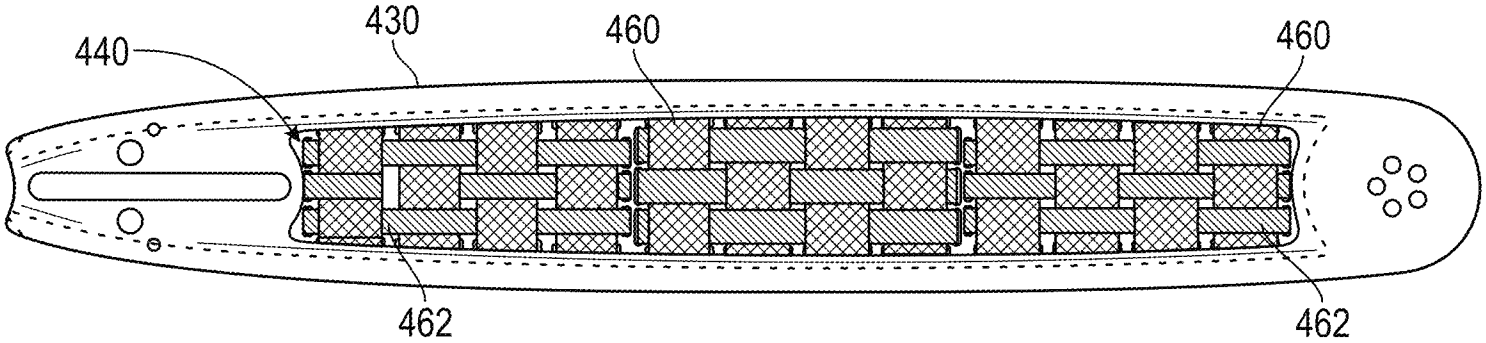
FIG. 6D illustrates the provision of cross members into the structure of FIG. 6C in accordance with an example embodiment.

Thereafter, as shown in FIG. 6D, woven material or unidirectional fiber may be used to define cross members that extend between opposing eyelets 410. The cross members may include first cross members 460 that extend between opposing eyelets 410 disposed to run parallel to a longitudinal axis of the base plate 400. The cross members may also include second cross members 462 that extend between opposing eyelets 410 disposed to run perpendicular to the longitudinal axis of the base plate 400. The first cross members 460 may therefore extend substantially perpendicular to the longitudinal axis of the base plate 400 while the second cross members 462 extend substantially parallel to the longitudinal axis of the base plate 400. The first cross members 460 are wider and shorter than the second cross members 462.

As shown in FIG. 6D, the first and second cross members 460 and 462 may be interleaved with each other so that each first cross member 460 passes adjacent to (and contacts) opposite sides of adjacent second cross members 462 encountered while extending between eyelets 410. Similarly, each second cross member 462 passes adjacent to (and contacts) opposite sides of adjacent first cross members 462 encountered while extending between eyelets 410. The resultant structure of FIG. 6D may be a well supported, but lighter structure than a fully metalized side plate.

Figure 6E:
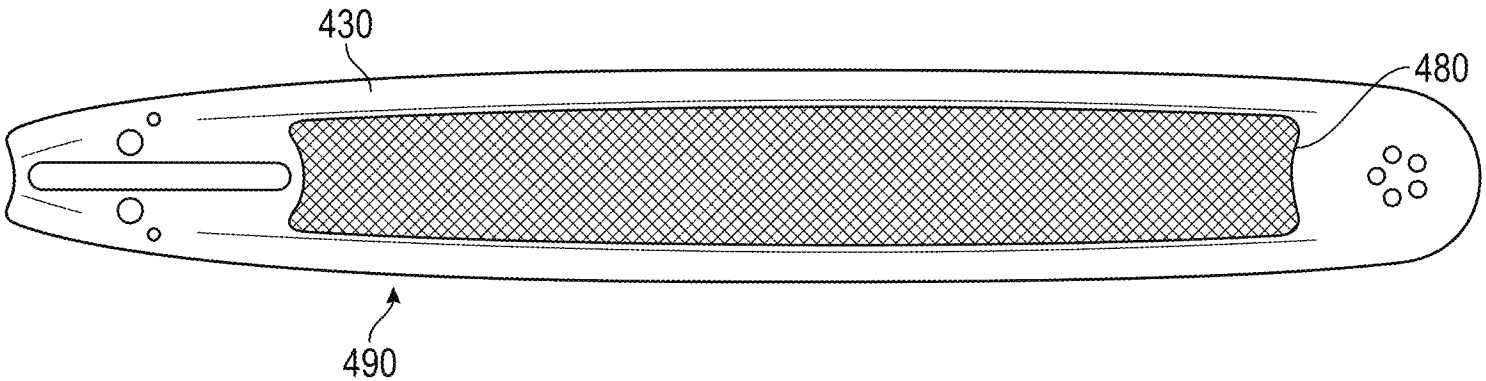
FIG. 6E illustrates an example embodiment in which resin is provided into the structure of FIG. 6D in accordance with an example embodiment.

In some cases, the recessed portions 440 of the side plates may then be filled in with resin 480 that can be injected therein to fill the gaps in the recessed portions 440 to provide smooth outer surfaces for both the first side plate 430 and the second side plate. FIG. 6E illustrates the resin 480 provided in all cavities of the recessed portions 440. The first and second cross members 460 and 462 may be made of a relatively low weight, non-metallic material such as graphene, glass fiber, carbon fiber, or the like. The resultant guide bar 490 may be relatively light, and yet very strong and durable. It should also be appreciated that some embodiments may omit the weaving of FIG. 6D and effectively move directly from the structure of 6C (or something similar thereto) to the structure of FIG. 6E, where the hollow interior of the guide bar 490 is completely filled with resin 480 instead of filling the resin 480 over the woven materials of FIG. 6D. Alternatively, one or more inserts or insert portions could be provided into the same gap. The inserts or insert portions could be non-metallic material (e.g., carbon fiber) sheets glued therein. It should also be appreciated that in these alternative embodiments, the gap in question could be one or more of the recessed portions 440 and aligned cutout portions 420. In other words, there could be only one large recessed portion/cutout portion instead of multiple smaller ones.

Figure 7:
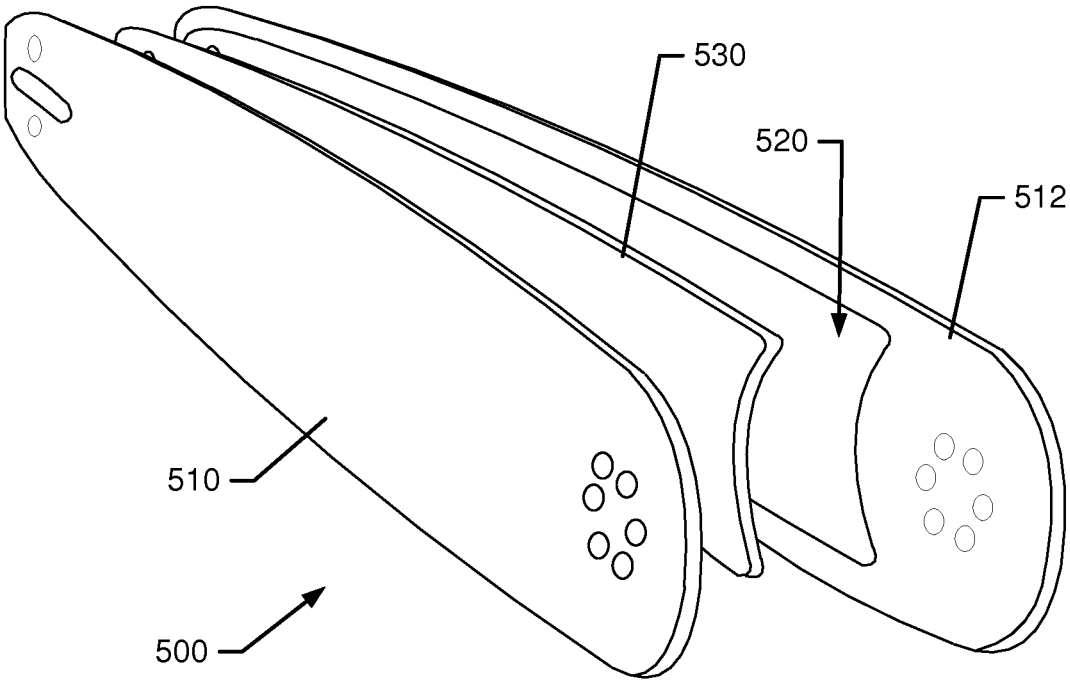
FIG. 7 illustrates an exploded perspective view of a lightweight guide bar in accordance with an example embodiment.

In other example embodiments, the side plates may be milled or molded to have cavities formed to receive a middle plate that is made of a low weight and/or high stiffness material in such a way that the middle plate defines a width for the channel inside which the chain rides. FIG. 7 illustrates an exploded perspective view of a lightweight guide bar 500 in accordance with an example embodiment. The guide bar 500 is formed from a first side plate 510 and a second side plate 512, each of which may be made of steel, or another rigid, metallic material. Each of the first side plate 510 and second side plate 512 may be formed to have a substantially smooth and/or flat outer surface (facing away from each other), while having inner surfaces (facing each other) that include recessed portions (e.g., recessed portions 520 (see FIG. 8E) and 522) that also face each other. The recessed portion 520 may be milled out of the second side plate 512 or may be formed in the second side plate 512 when the second side plate 512 is formed.

A base plate 530 may be formed to substantially match a shape of the recessed portions 520 and 522 to substantially fill the space formed by the recessed portions 520 and 522 and define a width (W1) of a channel 550 inside which the chain rides around the guide bar 500. The base plate 530 may be made from non-metallic, lower weight material (e.g., graphene, glass fiber, carbon fiber, or the like). By replacing the higher weight steel or metallic material of a typical guide bar with the base plate 530 at interior portions of the guide bar 500, the overall weight of a chainsaw employing the guide bar 500 may be reduced. The base plate 530 may be affixed to the first and second side plates 510 and 512 by an adhesive.

Figure 8A:
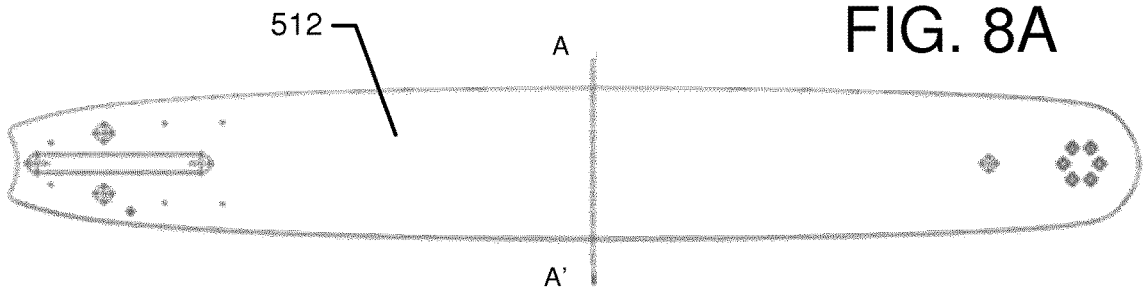
FIG. 8A illustrates a side view of an outside surface of a side plate in accordance with an example embodiment.
Figure 8B:
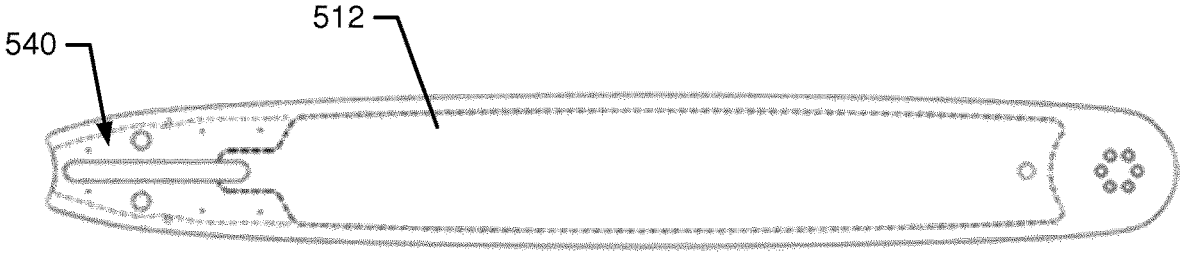
FIG. 8B illustrates a side view of an inside surface of the side plate in accordance with an example embodiment.
Figure 8C:
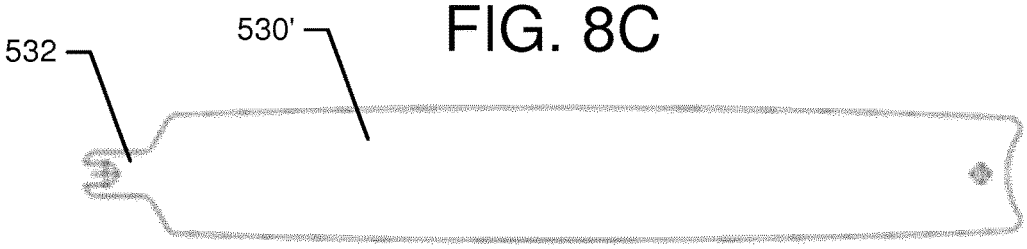
FIG. 8C illustrates an alternate base plate in accordance with an example embodiment.
Figure 8D:
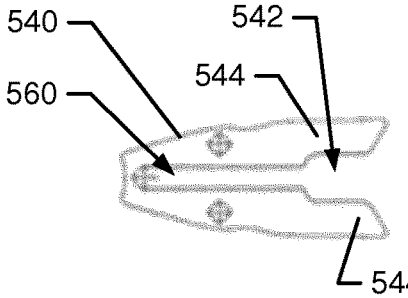
FIG. 8D illustrates an insert in accordance with an example embodiment.
Figure 8E:
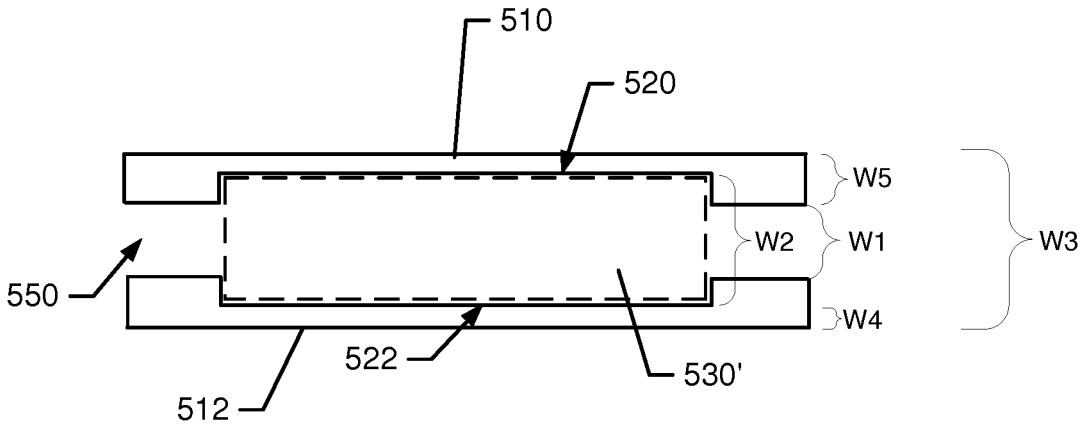
FIG. 8E illustrates a cross section view of the guide bar taken along line A-A' of FIG. 8A in accordance with an example embodiment.

FIG. 8, which is defined by FIGS. 8A, 8B, 8C, 8D and 8E, illustrates several aspects of the guide bar 500 in greater detail. In this regard, FIG. 8A illustrates a side view of an outside surface of the second side plate 512, while FIG. 8B illustrates a side view of an inside surface of the second side plate 512. Of note, the recessed portion 522 of the second side plate 512 of FIG. 8B is partially filled with an insert 540. The insert 540 is configured to mate with an alternate base plate 530' (see FIG. 8C) to substantially fill the void space formed when the first and second side plates 510 and 512 are joined with the base plate 530' and the insert 540. The base plate 530' is shown in greater detail in FIG. 8C, while the insert 540 is shown in isolation in FIG. 8D. A cross section view of the guide bar 500 taken along line A-A' of FIG. 8A is shown in FIG. 8E.

It should be noted that although the base plates 530 and 530' are each shown as substantially unitary structures without any through holes therethrough, it may be possible to remove some material from the base plates as well to reduce weight and material requirements. In such examples, portions of sides of the base plates 530 and 530' may be removed while leaving a lattice structure for support. The portions removed may extend all the way through the width of the base plates 530 and 530' or may be formed such that they do not pass all the way through the base plates 530 and 530'. It may also be possible to form the base plates 530 and 530' from individual pieces that can be joined together or otherwise placed proximate to each other during assembly.

As mentioned above, the base plate 530 may be configured to fit substantially all of the void space created by the recess portions 520 and 522. Meanwhile, the alternate base plate 530' may be shaped to fit substantially all of the void space except that which is filled by the insert 540. The insert 540 may be employed at the proximal end of the guide bar 500 relative to the housing 110. In this regard, for example, the insert 540 may be disposed at a portion of the guide bar 500 that is covered by the clutch cover 150. The clutch cover 150 may inhibit heat dissipation at portions of the guide bar 500 that are disposed between the clutch cover 150 and the housing 110 (see FIG. 1). As such, since some adhesives may tend to degrade in the presence of excessive heat, the use of the insert 540 may enable welding or riveting to be used to join the insert 540 and the first and second side plates 510 and 512 so that any adhesive is generally used where sufficient heat dissipation can occur to avoid adhesive degradation. At other portions of the guide bar 500, the base plate 530' may be joined to the first and second side plates 510 and 512 via adhesive. In some cases, a thermal barrier may be provided between the insert 540 and the base plate 530'.

In some examples, the insert 540 may include a receiving slot 542 configured to receive a projection 532 formed on the proximal end of the base plate 530'. The receiving slot 542 may be formed between respective arms 544 of the insert 540. The arms 544 may project toward a distal end of the guide bar 500 and, in some cases, may extend beyond the point at which the clutch cover 150 would cease to cover the guide bar 500. The receiving slot 542 may extend all the way to a slot 560 formed in the guide bar 500 to allow the nuts 152 to pass therethrough for chain tension to be adjusted by lateral movement of the guide bar 500 forward or rearward relative to the nuts 152 (see FIG. 1). Thus, the projection 532 may extend rearward (i.e., toward the proximal end of the guide bar 500) to the slot 560. The slot 560 may also be formed into both of the first and second side plate 510 and 512. The use of steel for the insert 540 may allow improved handling of mechanical stress, as well as handling of thermal stress.

Figure 9A:
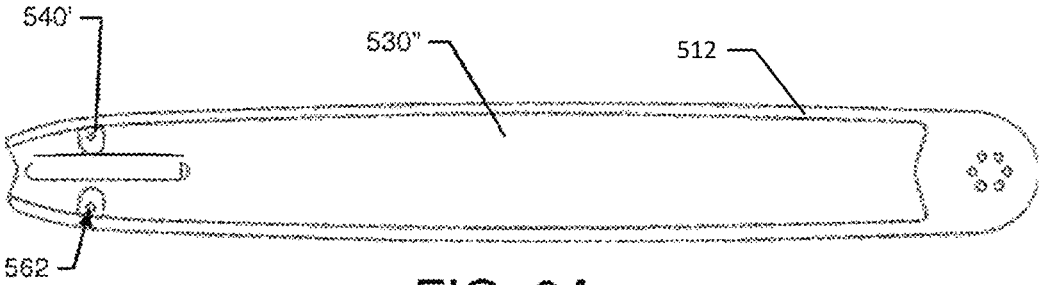
FIG. 9A illustrates a side view of a guide bar with a different insert in accordance with an example embodiment.
Figure 9B:
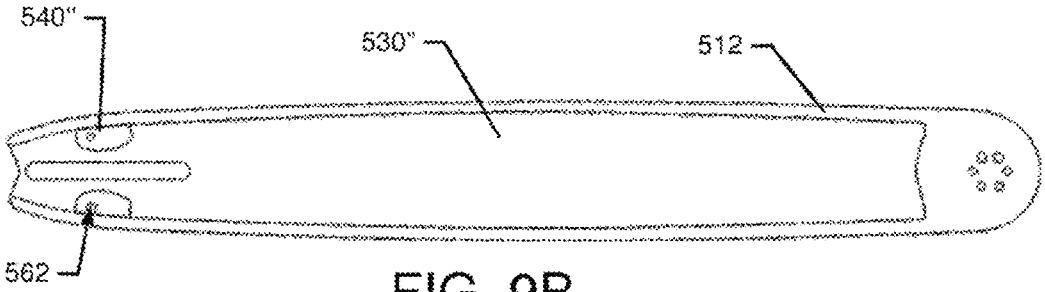
FIG. 9B illustrates a side view of an alternate guide bar structure with another different insert in accordance with an example embodiment.
Figure 9C:
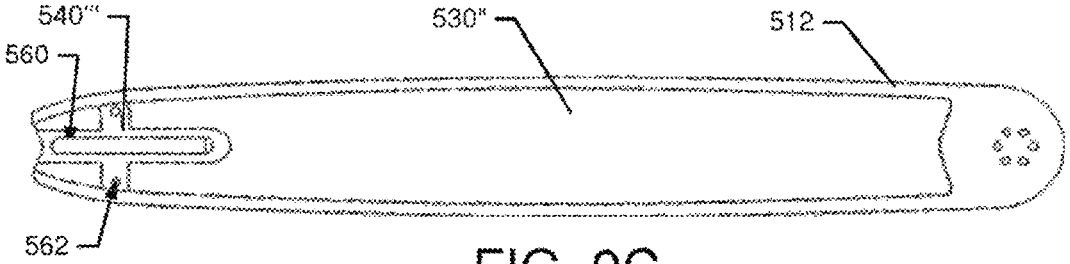
FIG. 9C illustrates a side view of a guide bar with still another different insert in accordance with an example embodiment.

In examples with the base plate 530, the slot 560 may be formed to pass through the base plate 530 as well. Additionally, when other through holes 562 are employed in the first and second side plates 510 and 512, such through holes 562 may also be formed in either the base plate 530, or if the base plate 530' is employed, the through holes 562 may be formed in the insert 540. However, in some examples (see FIG. 9A), a base plate 530" may be employed that accommodates smaller inserts 540' that only surround the through holes 562. In this example as well, the through holes 562 may be located at an area that sees relatively high heat production. Moreover, since the slot 560 has some open space to facilitate heat dissipation, and the area proximate to the through holes 562 can be separate from the slot 560, it may be desirable to provide steel or other metallic material that can be welded or riveted (instead of using adhesives) proximate to the through holes 562. FIG. 9B shows an alternative in which the inserts 540" inside which the through holes 562 are formed are much larger, and FIG. 9C illustrates a one piece insert 540' inside which the slot 560 and the through holes 562 may be formed.

As can be appreciated from FIG. 8E, a width (W2) of the base plate 530' may be larger than the width (W1) of the channel 550. However, the width (W2) of the base plate 530' effectively defines the width (W1) of the channel 550. In this regard, a width (W3) of the guide bar 500 may be equal to the width (W2) of the base plate 530' plus a width (W4) of each of the side plates 510 and 512 proximate to the recess portions 520 and 522. As such, the width (W3) of the guide bar 500 may also be equal to the width (W1) of the channel 530' plus a width (W5) of each of the side plates 510 and 512 at portions thereof that are not proximate to the recess portions 520 and 522. FIG. 8E further demonstrates that metal does not contact metal in this example over a majority of the length of the guide bar 500. Moreover, the first and second side plates 510 and 512 do not contact each other at all. Instead, metal only contacts other metal at portions where the insert 540 or 540' is employed. And at such locations, the first side plate 510 would be joined to the insert 540 or 540' (e.g., using adhesives, riveting or welding), and then the insert 540 or 540' would be joined to the second side plate 512. If welding is employed, in some cases, all three components could be welded in a single operation through one of the side plates.

Figure 8F:
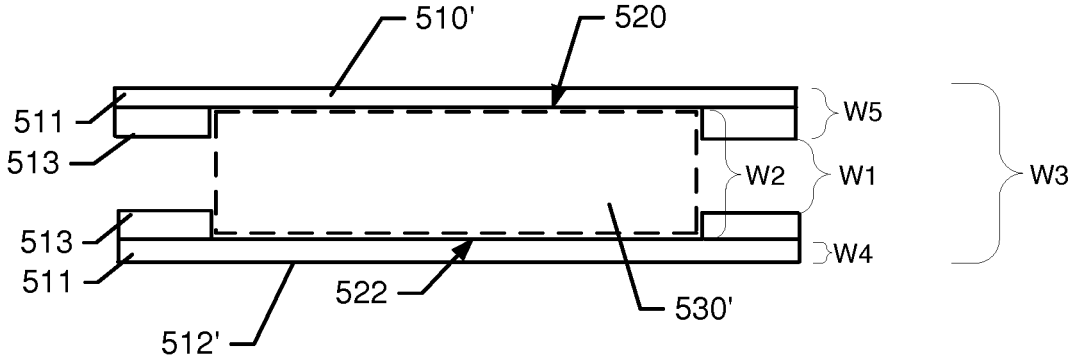
FIG. 8F illustrates an alternative structure to that of FIG. 8E.
Figure 8G:
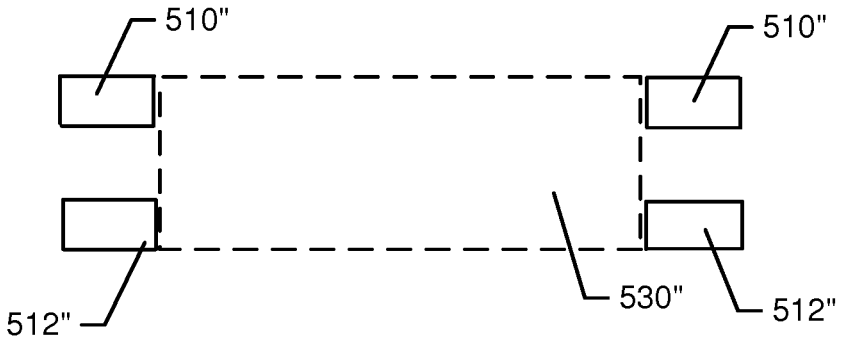
FIG. 8G illustrates another alternative structure to that of FIGS. 8E and 8F.

Alternate structures to that of FIG. 8E are also possible. For example, FIG. 8F illustrates an example that is substantially identical to the example of FIG. 8E except that the recess portions 520 and 522 are not formed by milling, but are instead formed by using first and second side plates 510' and 512' that are formed from separate portions including, for example, base portions 511 and perimeter portions 513. The perimeter portions 513 may have substantially the same shape as the base portions 511, but may be hollowed out at their centers with the hollowed out portion substantially matching a shape of the base plate 530'. The perimeter portions 513 may be attached to their respective base portions 511 by welding, riveting, adhesives, soldering and/or the like. As yet another alternative (shown in FIG. 8G), the base plate 530" may extend all the way through the first and second side plates 510" and 512".

As shown in FIGS. 7-9, the slot 560 and through holes 562 may be the only holes formed through the proximal end of the first and second side plates 510 and 512 in some cases. Moreover, the inclusion of material, whether metallic or non-metallic, proximate to the slot 560 and through holes 562 may be continuously provided. However, in some examples, it may be desirable to remove some more of the metallic material of the guide bar, particularly in regions that are not visible due to coverage of the clutch cover 150 (see FIG. 1).

Figure 10A:
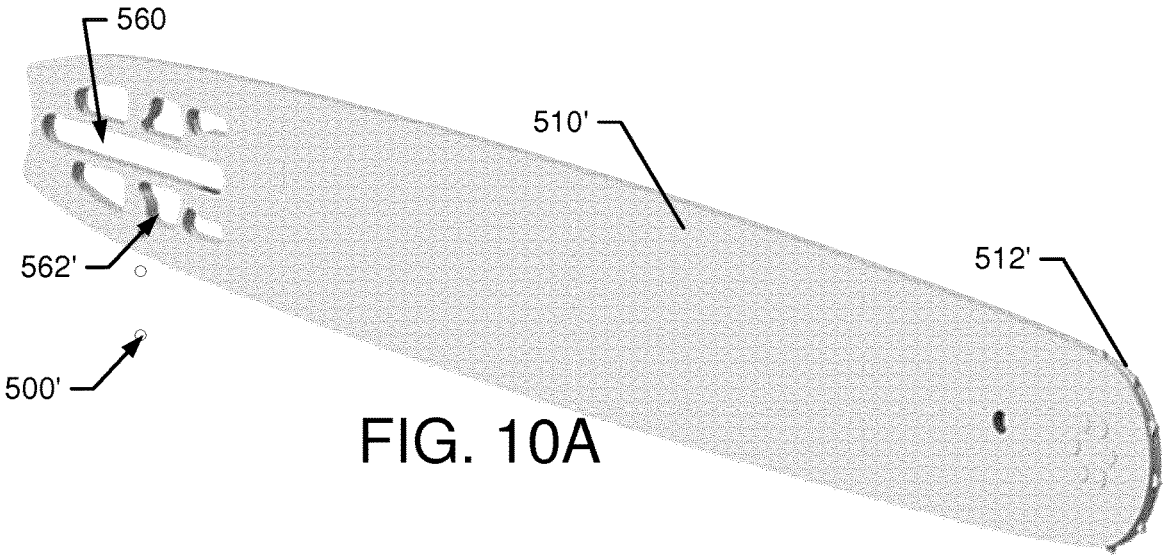
FIG. 10A illustrates a perspective view of another alternative guide bar in accordance with an example embodiment.
Figure 10B:
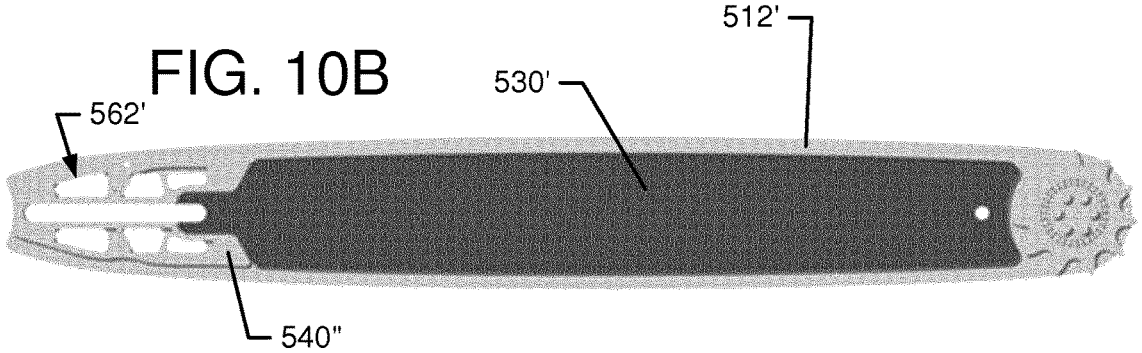
FIG. 10B illustrates a side view of a second side plate of the guide bar in accordance with an example embodiment.
Figure 10C:
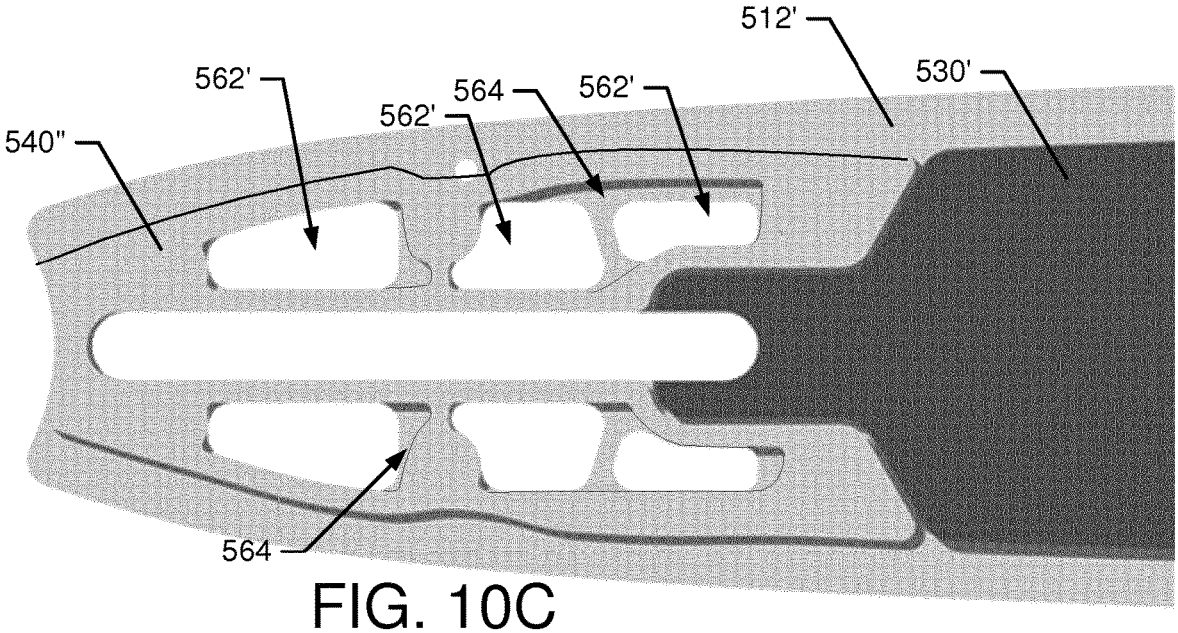
FIG. 10C illustrates a detailed side view of the insert of the guide bar of FIG. 10B in accordance with an example embodiment.

Accordingly, yet another alternative embodiment may be provided in which portions of the side plates are removed to further lighten the guide bar. In this regard, an alternative guide bar 500' is shown in FIG. 10, which is defined by FIGS. 10A, 10B and 10C. FIG. 10A illustrates a perspective view of the guide bar 500' in accordance with an example embodiment. The guide bar 500' includes first and second side plates 510' and 512' that are similar to the first and second side plates 510 and 512 described above except that they include more material removed at the proximal end of the guide bar 500'. The additional material removed from the first and second side plates 510' and 512' results in the formation of more numerous and larger through holes 562', which can have irregular shapes. These through holes 562' may create a reinforcing metallic lattice of material that keeps strength high, but the removal of material lightens the overall weight of the guide bar 500'. It should also be appreciated that this strategy may be employed in connection with the examples described above in reference to FIGS. 2-6.

FIG. 10B illustrates a side view of the second side plate 512' in accordance with an example embodiment, and FIG. 10C illustrates a similar side view except that it provides a more detailed view of the region in which the through holes 562' are formed (i.e., the proximal end of the guide bar 500'). As shown in FIGS. 10B and 10C, the through holes 562' formed in the second side plate 512' may not match exactly with through holes 564 formed in insert 540". The insert 540" may therefore be similar in shape to the insert 540 described in reference to FIG. 8, except that the insert 540" includes the through holes 564 formed therethrough. Although the through holes 564 could be formed to match the shape and position of the through holes 562' formed in the side plates, more material could be removed in the insert 540" to further lighten the guide bar 500'. In this example, multiple through holes 562' of the side plates may correspond to a single through hole 564 of the insert 540" in at least one instance, and one through hole 562' may be provided to correspond to at least one through hole 564 of the insert 540" in at least another instance. However, it could be the case that more than one through holes 562' of the side plates corresponds to a single through hole 564 of the insert 540" in all instances in an alternative embodiment. Similarly, it could be the case that only one through hole 562' is provided to correspond to each individual through hole 564 of the insert 540" in another alternative embodiment. The shapes of such holes may be either the same or different as well in various example embodiments.

Figure 11:
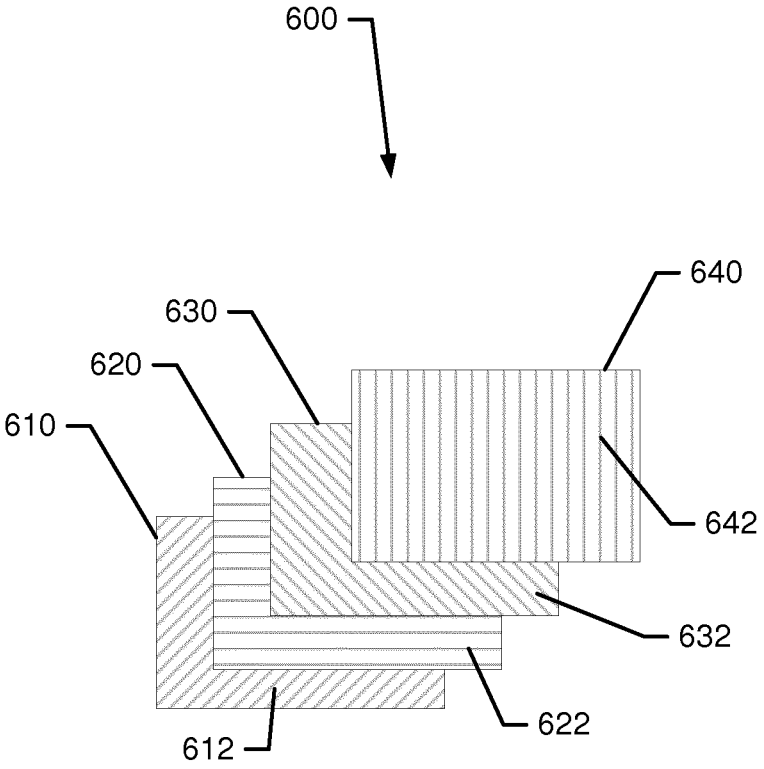
FIG. 11 illustrates a base plate made from multiple layers of material in accordance with an example embodiment.

In some examples, the base plate (240, 400, 530, 530') may be made from a single layer of woven material or unidirectional fiber. However, in other examples, the base plate itself may be made from multiple layers of material. As such, an example base plate 600 is shown in FIG. 11. The base plate 600 may be an example that may be used as a replacement for a base plate with a single layer of unidirectional fibers that may be used in connection with any of the examples described above.

As shown in FIG. 11, the base plate 600 may include a first layer 610, a second layer 620, a third layer 630 and a fourth layer 640. However, it should be appreciated that more layers (e.g., seven) or fewer layers (e.g., 2 or 3) could be used in alternative embodiments. When multiple layers are used, the layers may be laminated together to form the base plate 600 and may be joined by adhesives or any other suitable joining method. Although in some cases, each of the first layer 610, the second layer 620, the third layer 630 and the fourth layer 640 may be formed to have fibers that have the same orientation, it may be desirable to employ layers with different fiber orientations in alternative embodiments. Thus, for example, as shown in FIG. 11, the first layer 610 may have fibers 612 having a first fiber direction, while the second layer 620 has fibers 622 having a second fiber direction, the third layer 630 has fibers 632 having a fourth fiber direction, and the fourth layer 640 has fibers 642 having a fourth fiber direction. Each of the first fiber direction, the second fiber direction, the third fiber direction and the fourth fiber direction may be different from each other. However, in some cases, it may be desirable to repeat layers with similar fiber directions.

As can be appreciated from FIG. 11, the second fibers 622 may be arranged to extend along the longitudinal length of the guide bar. Thus, the second fibers 622 may be as long as (or nearly as long as) the length of the guide bar. Meanwhile, the fourth fibers 642 may be arranged to extend substantially perpendicular to the direction of extension of the second fibers 622. Thus, the fourth fibers 642 may be substantially shorter than the second fibers 622. Moreover, the fourth fibers 642 may be shorter than the width of the guide bar. The first fibers 612 and the third fibers 632 may be provided at some angle in between the directions of extension of the second fibers 622 and the fourth fibers 642, and therefore may have lengths in between the lengths of the second fibers 622 and the fourth fibers 642. In some cases, the first fibers 612 may extend to form a 0 degree or 45 degree angle (and as much as 90 degrees) relative to the direction of extension of the second fibers 622.

A chainsaw of an example embodiment may therefore include a power unit disposed in a housing and a working assembly powered responsive to operation of the power unit. The working assembly may include a guide bar around which a chain is rotatable. The guide bar may include a first side plate and a second side plate facing each other and extending away from the housing to a nose of the guide bar. The first and second side plates may each include an inner sidewall facing inwardly toward each other. Each of the inner sidewalls may include a recessed portion at which material of the inner sidewalls has been removed.

In some embodiments, additional optional features may be included or the features described above may be modified or augmented. Each of the additional features, modification or augmentations may be practiced in combination with the features above and/or in combination with each other. Thus, some, all or none of the additional features, modifications or augmentations may be utilized in some embodiments. For example, in some cases, respective recessed portions of the inner sidewalls may substantially mirror each other about a plane passing through a longitudinal centerline of the guide bar parallel to respective planes in which the first and second side plates extend. In some embodiments, a base plate may be disposed between the first and second side plates. In an example embodiment, the base plate may be spot welded, laser welded, riveted, soldered, or joined with an adhesive to the first and second side plates. In some cases, the base plate and the first and second side plates may be welded to each other through one of the first side plate or the second side plate. In an example embodiment, the base plate may include a plurality of cutout portions disposed in the base plate to substantially align with the respective recessed portions of the inner sidewalls. In some embodiments, the cutout portions may have substantially a same size and shape as openings of the respective recessed portions. In some cases, an insert may be disposed between the first and second side plates at a proximal end of the guide bar. In an example embodiment, the insert may be welded or riveted to each of the first and second side plates. In some embodiments, the base plate may include multiple laminated layers of carbon fiber material. In such an example, fibers in at least one of the layers have a different orientation than fibers of another layer. Alternately or additionally, the fibers of the at least one of the layers are substantially orthogonal to the fibers of the another layer. Alternately or additionally, fibers in at least one of the layers may have an angle of orientation between about 0 degrees and 90 degrees different than fibers of another layer. In an example embodiment, a width of the base plate may be greater than a width of a channel in which the chain moves around the guide bar. In some cases, the first and second side plates do not contact each other. In an example embodiment, the first and second side plates each include extension portions having a larger thickness than other portions of the first and second side plates, and the extension portions may extend toward each other from the inner sidewalls to define boundaries of the respective recessed portions. In some cases, the extension portions of the first and second side plates may be joined to each other by spot welding, riveting, laser welding, soldering, or an adhesive. In an example embodiment, the recessed portions may extend fully through the first and second side plates. A base plate may be disposed between the first and second side plates, such that the base plate includes a plurality of cutout portions that are visible through the recessed portions when the base plate is joined to the first and second side plates. Eyelets may be disposed on opposing sides of the cutout portions, and cross members may be alternatingly woven amongst each other between respective eyelets on the opposing sides of the cutout portions. In an example embodiment, a resin may be provided over the cross members within the recessed portions to define a guide bar with a metallic periphery and substantially non-metallic interior. In some cases, a wear ring having a low friction may be provided at a nose portion of the guide bar. In some embodiments, the recessed portions extend fully through the first and second side plates. In such an example, a base plate may be disposed between the first and second side plates. The base plate may include a plurality of cutout portions that are visible through the recessed portions when the base plate is joined to the first and second side plates along with resin or an insert including one or more sheets of a non-metallic material fills the cutout portions.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

The invention claimed is:

1. A guide bar for guiding a chain of a chainsaw, the guide bar being operably coupled to a housing of the chainsaw, the guide bar comprising:

a first side plate comprising a first planar inner sidewall and a first planar outer sidewall, the first planar inner and outer sidewalls being spaced apart from each other by a consistent distance over an entire length of the first side plate; and a second side plate comprising a second planar inner sidewall and a second planar outer sidewall, the second planar inner and outer sidewalls being spaced apart from each other by the consistent distance over an entire length of the second side plate, wherein the first side plate and the second side plate extend away from the housing to a nose of the guide bar, wherein the first and second planar inner sidewalls face inwardly toward each other and the first and second planar outer sidewalls face outwardly away from each other, wherein the first and second planar inner sidewalls each include a recessed portion extending toward the first and second planar outer sidewalls at which material of the first and second planar inner sidewalls has been removed to a depth less than the consistent distance between the first and second planar inner sidewalls and the first and second planar outer sidewalls, and wherein the first and second planar outer sidewalls are continuous metallic planar surfaces.

2. The guide bar of claim 1, wherein respective recessed portions of the first and second planar inner sidewalls substantially mirror each other about a plane passing through a longitudinal centerline of the guide bar parallel to respective planes in which the first and second side plates extend.

3. The guide bar of claim 1, wherein a base plate is disposed between the first and second side plates.

4. The guide bar of claim 3, wherein the base plate is spot welded, laser welded, soldered, or joined with an adhesive to the first and second side plates.

5. The guide bar of claim 4, wherein the base plate and the first and second side plates are welded to each other through one of the first side plate or the second side plate.

6. The guide bar of claim 3, wherein the base plate comprises a plurality of cutout portions disposed in the base plate to substantially align with the respective recessed portions of the first and second planar inner sidewalls.

7. The guide bar of claim 6, wherein the cutout portions have substantially a same size and shape as openings of the respective recessed portions.

8. The guide bar of claim 3, wherein an insert is disposed between the first and second side plates at a proximal end of the guide bar, and wherein the insert is welded or riveted to each of the first and second side plates.

9. The guide bar of claim 3, wherein the base plate comprises multiple laminated layers of carbon fiber, glass fiber, polymer or other light material, and wherein fibers in at least one of the layers have a different orientation than fibers of another layer.

10. The guide bar of claim 9, wherein the fibers of the at least one of the layers are substantially orthogonal to the fibers of the another layer.

11. The guide bar of claim 3, wherein the base plate comprises multiple laminated layers of carbon fiber, glass fiber, polymer or other light material, and wherein fibers in at least one of the layers have an angle of orientation between about 0 degrees and 90 degrees different than fibers of another layer.

12. The guide bar of claim 3, wherein a width of the base plate is greater than a width of a channel in which the chain moves around the guide bar, and wherein the first and second side plates do not contact each other.

13. The guide bar of claim 1, wherein the first and second side plates each comprise extension portions having a larger thickness than other portions of the first and second side plates, the extension portions extending toward each other from the first and second planar inner sidewalls to define boundaries of the respective recessed portions.

14. The guide bar of claim 13, wherein the extension portions of the first and second side plates are joined to each other by spot welding, laser welding, soldering, or an adhesive.

15. A guide bar for guiding a chain of a chainsaw, the guide bar being operably coupled to a housing of the chainsaw, the guide bar comprising:

a first side plate comprising a first planar inner sidewall and a first planar outer sidewall, the first planar inner and outer sidewalls being spaced apart from each other by a consistent distance over an entire length of the first side plate; and a second side plate comprising a second planar inner sidewall and a second planar outer sidewall, the second planar inner and outer sidewalls being spaced apart from each other by the consistent distance over an entire length of the second side plate, wherein the first side plate and the second side plate extend away from the housing to a nose of the guide bar, wherein the first and second planar inner sidewalls face inwardly toward each other and the first and second planar outer sidewalls face outwardly away from each other, wherein the first and second planar inner sidewalls each include recessed portions extending toward the first and second planar outer sidewalls at which material of the first and second planar inner sidewalls has been removed, wherein the recessed portions extend fully through the first and second side plates, wherein the removed material of the recessed portions is uninterrupted away from a perimeter of the first and second side plates, and wherein a resin is provided within the recessed portions.

16. The guide bar of claim 15, wherein a base plate is disposed between the first and second side plates, the base plate including a plurality of cutout portions that are visible through the recessed portions when the base plate is joined to the first side plate, wherein eyelets are disposed on opposing sides of the cutout portions, wherein non-metallic cross members are alternatingly woven amongst each other between respective eyelets on the opposing sides of the cutout portions, and wherein the resin is provided over the cross members within the recessed portions to define a guide bar with a metallic periphery and substantially non-metallic interior.

17. The guide bar of claim 1, wherein a wear ring having a low friction is provided at a nose portion of the guide bar.

18. The guide bar of claim 15, wherein the resin completely fills the recessed portions.

19. A guide bar for guiding a chain of a chainsaw, the guide bar being operably coupled to a housing of the chainsaw, the guide bar comprising:

a first side plate defined by a first planar inner member and a first planar outer member, the first planar inner and outer members being spaced apart from each other by a consistent distance over an entire length of the first side plate;

a second side plate defined by a second planar inner member and a second planar outer member, the second planar inner and outer members being spaced apart from each other by the consistent distance over an entire length of the second side; and a base plate disposed between the first and second side plates, wherein the first and second planar inner members face inwardly toward each other and the first and second planar outer members face outwardly away from each other, wherein both the first and second side plates extend away from the housing to a nose of the guide bar, wherein the first and second planar inner members each include a recessed portion at which material thereof has been removed such that the recessed portion only partially extends through the first and second side plates to a depth less than the consistent distance between the first and second planar inner members and the first and second planar outer members, wherein the base plate further comprises cutout portions, and wherein the first and second planar outer members opposite are continuous metallic planar surfaces.

20. The guide bar of claim 19, wherein the base plate is formed from a metallic material, wherein an outer periphery of the base plate defines a chain track about which a chain of the chainsaw is movable during operation of the chainsaw, and wherein the chain track is coated or surface treated to increase wear resistance.

* * * * *